US007720248B2

(12) United States Patent
Sasaki et al.

(10) Patent No.: US 7,720,248 B2
(45) Date of Patent: May 18, 2010

(54) FRAME FOR SPEAKER DEVICE AND SPEAKER DEVICE

(75) Inventors: Hiromitsu Sasaki, Yamagata (JP); Yutaka Moriyama, Yamagata (JP); Eiji Sakaguchi, Saitama (JP); Hidehito Oki, Saitama (JP); Tsutomu Harano, Saitama (JP); Masaki Soda, Saitama (JP); Nobuo Aizawa, Saitama (JP); Ryoji Matsuo, Saitama (JP)

(73) Assignees: Pioneer Corporation, Tokyo (JP); Tohoku Pioneer Corporation, Tendo-shi (JP); Honda Motor Co., Ltd., Tokyo (JP)

( * ) Notice: Subject to any disclaimer, the term of this patent is extended or adjusted under 35 U.S.C. 154(b) by 1127 days.

(21) Appl. No.: 11/356,093

(22) Filed: Feb. 17, 2006

(65) Prior Publication Data

US 2006/0198546 A1 Sep. 7, 2006

(30) Foreign Application Priority Data

Feb. 17, 2005 (JP) ..... 2005-040047

(51) Int. Cl.
*H04R 25/00* (2006.01)

(52) U.S. Cl. ..... 381/433; 381/420; 181/148

(58) Field of Classification Search ..... 381/433, 381/395, 420, 430, 396, 399, 412; 181/148, 181/171, 199
See application file for complete search history.

(56) References Cited

U.S. PATENT DOCUMENTS

| | | | | |
|---|---|---|---|---|
| 2,312,238 | A * | 2/1943 | Cunningham | 381/420 |
| 6,567,529 | B1 * | 5/2003 | Roark | 381/423 |
| 7,031,490 | B2 * | 4/2006 | Stompler | 381/433 |
| 7,331,420 | B2 * | 2/2008 | Sasaki et al. | 181/148 |
| 2006/0188123 | A1 * | 8/2006 | Sasaki et al. | 381/386 |

FOREIGN PATENT DOCUMENTS

| | | |
|---|---|---|
| JP | 2001-352590 | 12/2001 |
| JP | 2002-125293 | 4/2002 |
| JP | 2002-142290 | 5/2002 |
| JP | 2003-37891 | 2/2003 |

* cited by examiner

*Primary Examiner*—Fan Tsang
*Assistant Examiner*—Phylesha Dabney
(74) *Attorney, Agent, or Firm*—Young & Thompson

(57) ABSTRACT

A frame for a speaker device includes a magnetic circuit housing unit which houses a magnetic circuit, an annular outer peripheral portion which is arranged on an outer side of the magnetic circuit housing unit, and plural arm portions which connect the magnetic circuit housing unit and the outer peripheral portion. The plural arm portions form such plural bridges that a pair of the arm portions are linearly positioned to connect two parts of the outer peripheral portion, and each of the bridges does not pass through a center of the outer peripheral portion.

9 Claims, 6 Drawing Sheets

FRAME FOR SPEAKER DEVICE AND SPEAKER DEVICE

BACKGROUND OF THE INVENTION

1. Field of the Invention

The present invention relates to a configuration of a frame for a speaker device.

2. Description of Related Art

Conventionally, there is known a speaker device including a vibrating system having a frame and a diaphragm, and a magnetic circuit system having a yoke, a magnet and a plate.

In such a speaker device, the frame is formed into a bowl shape, for example. The frame having such a shape includes a magnetic circuit housing unit holding a magnetic circuit, an outer peripheral portion disposed on an outer side of the magnetic circuit housing unit and having an edge mounting portion on which an outer peripheral portion of an edge is mounted, and plural arm portions connecting the magnetic circuit housing unit and the outer peripheral portion.

Particularly, on the frame having such a configuration, the plural arm portions are provided to radially extend from a center of the frame to the outer peripheral portion. In addition, in such a frame, plural mounting portions for mounting the speaker device onto a mounting base such as an inner panel of a vehicle door are provided at the outer peripheral portion. Examples of the frame having the configuration of this kind are disclosed in Japanese Patent Applications Laid-open under No. 2001-352590, No. 2002-125293, No. 2002-142290 and No. 2003-37891 (hereinafter, referred to as "documents D1 to D4", respectively).

In the speaker frame according to the above-mentioned document D1, two fixing hooks and one fixing clip to be fixed to mounting holes formed on the inner panel are arranged on an inner side of an outer peripheral edge portion of an annular seal member in order to prevent water from entering an inner side of the vehicle. In addition, in the speaker frame according to the above-mentioned document D2, plural dimples are provided at plural bridge portions (arm portions) in order to enhance strength. Moreover, in the speaker frame according to the above-mentioned document D3, each leg portion (arm portion) is formed in a column state and the width X of each leg portion is equal to or smaller than the thickness Y thereof in order to enhance a rate of opening of a rear portion of the diaphragm without deteriorating the strength and realize lightening of the speaker frame and lowering of the cost. Further, in the speaker frame according to the above-mentioned document D4, screw holes for fixing it to a baffle and a cabinet are provided at a peripheral edge portion of the outer peripheral portion thereof.

In the frame according to the above-mentioned speaker devices, the plural arm portions are provided to radially extend from the center of the frame to the outer peripheral portion. However, the plural arm portions and the mounting portions arranged at the outer peripheral portion of the frame are not designed to have an organic association (regularity).

Therefore, in the speaker device having such a frame, at the time of the driving, vibration occurring to the magnetic circuit, caused by a reaction to the vibration of the diaphragm, is transmitted to the outer peripheral portion of the frame via the plural arm portions. Thereby, the frame is problematically distorted, which easily causes distortion of sound quality.

SUMMARY OF THE INVENTION

The present invention has been achieved in order to solve the above problems. It is an object of this invention to provide a frame for a speaker device and a speaker device using the frame capable of improving the strength of the frame and preventing distortion of the frame and deterioration of sound quality by designing the frame in consideration of an organic association (regularity) of plural arm portions and mounting portions provided on a mounting base.

According to one aspect of the present invention, there is provided a frame for a speaker device including: a magnetic circuit housing unit which houses a magnetic circuit; an annular outer peripheral portion which is arranged on an outer side of the magnetic circuit housing unit; and plural arm portions which connect the magnetic circuit housing unit and the outer peripheral portion, wherein the plural arm portions form such plural bridges that a pair of the arm portions are linearly positioned to connect two parts of the outer peripheral portion, and wherein each of the bridges does not pass through a center of the outer peripheral portion.

In the above-mentioned frame for the speaker device, the pair of the plural arm portions connecting the magnetic circuit housing unit and the outer peripheral portion are linearly positioned to form the bridges connecting the two parts of the outer peripheral portion. Namely, the plural arm portions form the plural bridges. The plural bridges are formed at the position which does not pass through the center of the outer peripheral portion and serve as reinforcement members against stress applied to the outer peripheral portion from the outer side. Thereby, the strength of the frame is enhanced.

In a manner of the above frame, the plural bridges may include at least first and second bridges, and the first and second bridges may be arranged at positions corresponding to sides of a triangle inscribed in the outer peripheral portion. In this manner, the triangle inscribed in the outer peripheral portion, including the two bridges, reinforces the annular outer peripheral portion from the inner side, and the strength of the frame is securely improved.

In a preferred example of the above frame, the outer peripheral portion may have plural mounting portions provided on a mounting base, and both ends of the first and second bridges may be arranged at positions corresponding to the plural mounting portions. Since the plural mounting portions are fixed to the mounting base such as a mounting panel of a vehicle, by making both ends of the bridge correspondent to the mounting portion, the bridge can more securely improve the strength of the frame.

In a preferred example of the above frame, the first and second bridges may be arranged at positions symmetrical with respect to a central line passing through the center of the outer peripheral portion and corresponding to a diameter of the outer peripheral portion, and the plural bridges may include bridges arranged at positions substantially crossing the central line. In still another preferred example, the bridges arranged at the positions substantially crossing the central line may include third and fourth bridges, and the third and fourth bridges may be provided on an upper side and a lower side of a perpendicular line passing through the center of the outer peripheral portion and perpendicular to the central line, respectively, when the outer peripheral portion is planarly observed. Thereby, by the plural bridges, the frame is reinforced against the stress applied in the central line direction and the perpendicular direction.

In still another preferred example of the above frame, the plural mounting portions may include first to third mounting portions; the first mounting portion may be arranged at a position corresponding to 12 o'clock in a clockwise direction, the second mounting portion may be arranged at a position corresponding to 3 to 6 o'clock in the clockwise direction, and the third mounting portion may be arranged at a position corresponding to 6 to 9 o'clock in the clockwise direction, respectively, when the outer peripheral portion is planarly observed; ends of the first and second bridges may be arranged at a position corresponding to the first mounting portion, respectively; another end of the first bridge may be arranged at a position corresponding to the third mounting portion, and another end of the second bridge may be arranged at a position corresponding to the second mounting portion, respectively. Thereby, the strength of the frame can be improved against the stress in any directions of the outer peripheral portion.

In a preferred example in this case, the first bridge may be positioned on a line connecting the first mounting portion and the third mounting portion, and the second bridge may be positioned on a line connecting the first mounting portion and the second mounting portion. Since the plural mounting portions are fixed to the mounting base such as a mounting panel of the vehicle, by making both ends of the bridge correspondent to the mounting portion, the bridge can more securely improve the strength of the frame.

In still another manner of the above frame, the first and second bridges may be formed into a curved and arch shape, respectively. Thereby, the stress operating on each bridge disperses to the whole bridge without concentrating on one point on the bridge. Therefore, it becomes possible to correspond to much larger stress.

According to another aspect of the present invention, there is provided a speaker device including a frame, the frame including: a magnetic circuit housing unit which houses a magnetic circuit; an annular outer peripheral portion which is arranged on an outer side of the magnetic circuit housing unit; and plural arm portions which connect the magnetic circuit housing unit and the outer peripheral portion, wherein the plural arm portions form such plural bridges that a pair of the arm portions are linearly positioned to connect two parts of the outer peripheral portion, and wherein each of the bridges does not pass through a center of the outer peripheral portion.

The nature, utility, and further features of this invention will be more clearly apparent from the following detailed description with respect to preferred embodiment of the invention when read in conjunction with the accompanying drawings briefly described below.

DETAILED DESCRIPTION OF THE PREFERRED EMBODIMENTS

The preferred embodiments of the present invention will now be described below with reference to the attached drawings. In this embodiment, by designing the frame in consideration of the organic association (regularity) of the plural arm portions and the mounting portions provided on the mounting base, the strength of the frame is enhanced, and the distortion of the frame is prevented. Thereby, the deterioration of the sound quality is prevented.

[Configuration of Speaker Device]

First, a description will be given of a configuration of a speaker device 100 according to an embodiment of the present invention with reference to FIG. 1 to FIG. 5.

Figure 1:
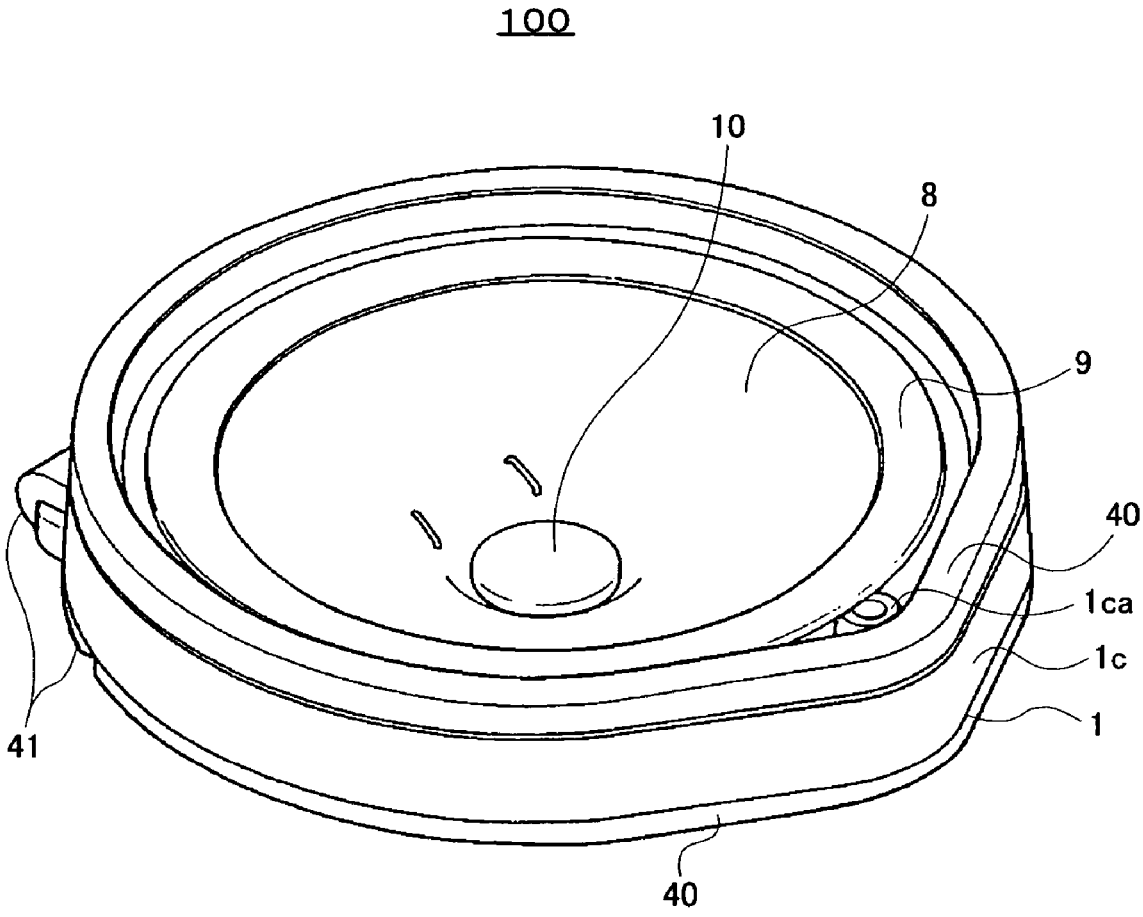
FIG. 1 shows a perspective view of a speaker device in a case that the speaker device according to an embodiment of the present invention is observed from a sound output side.
Figure 2:
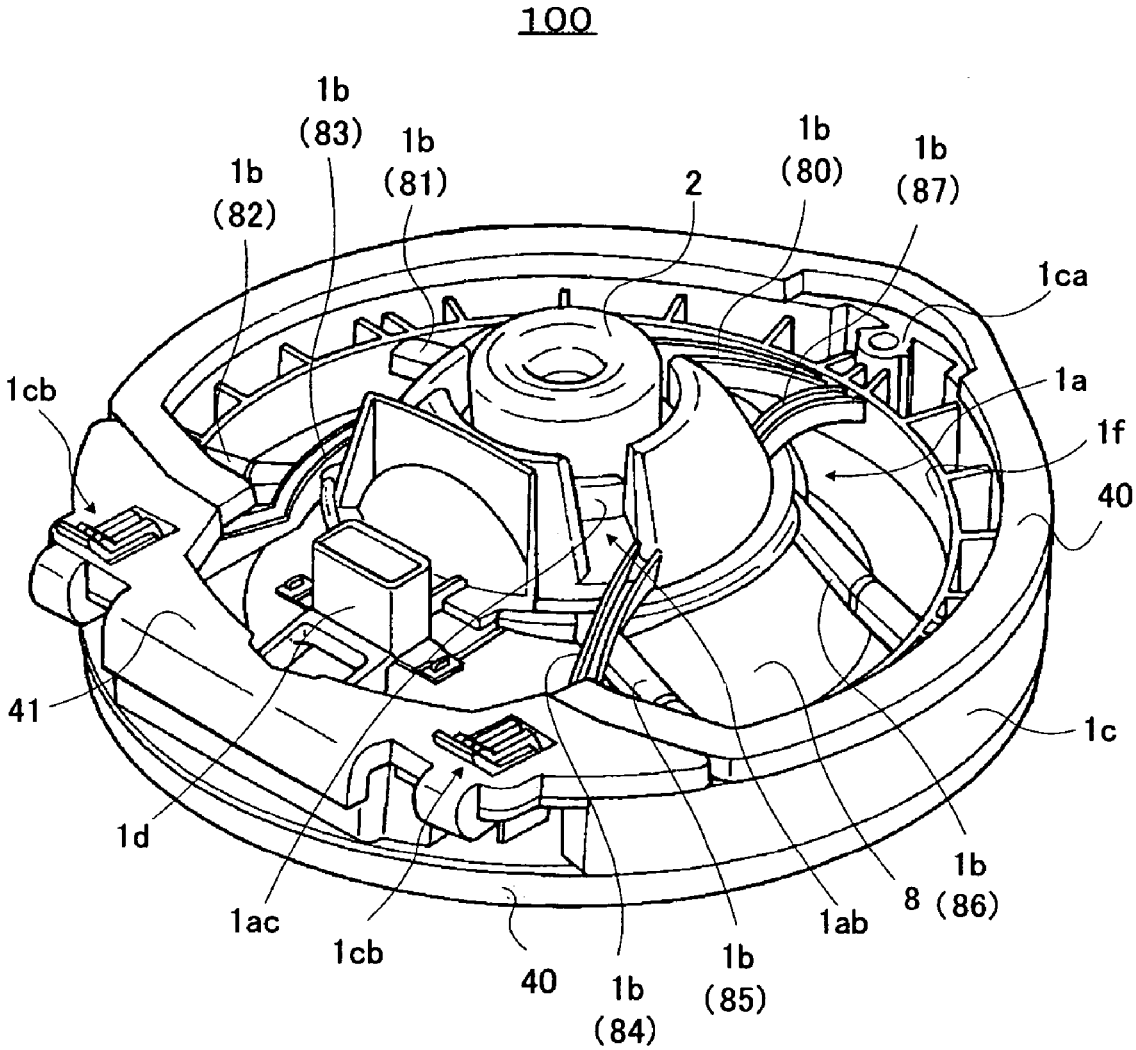
FIG. 2 is a perspective view of the speaker device in a case that the speaker device according to this embodiment is observed from a side opposite to the sound output side.
Figure 3:
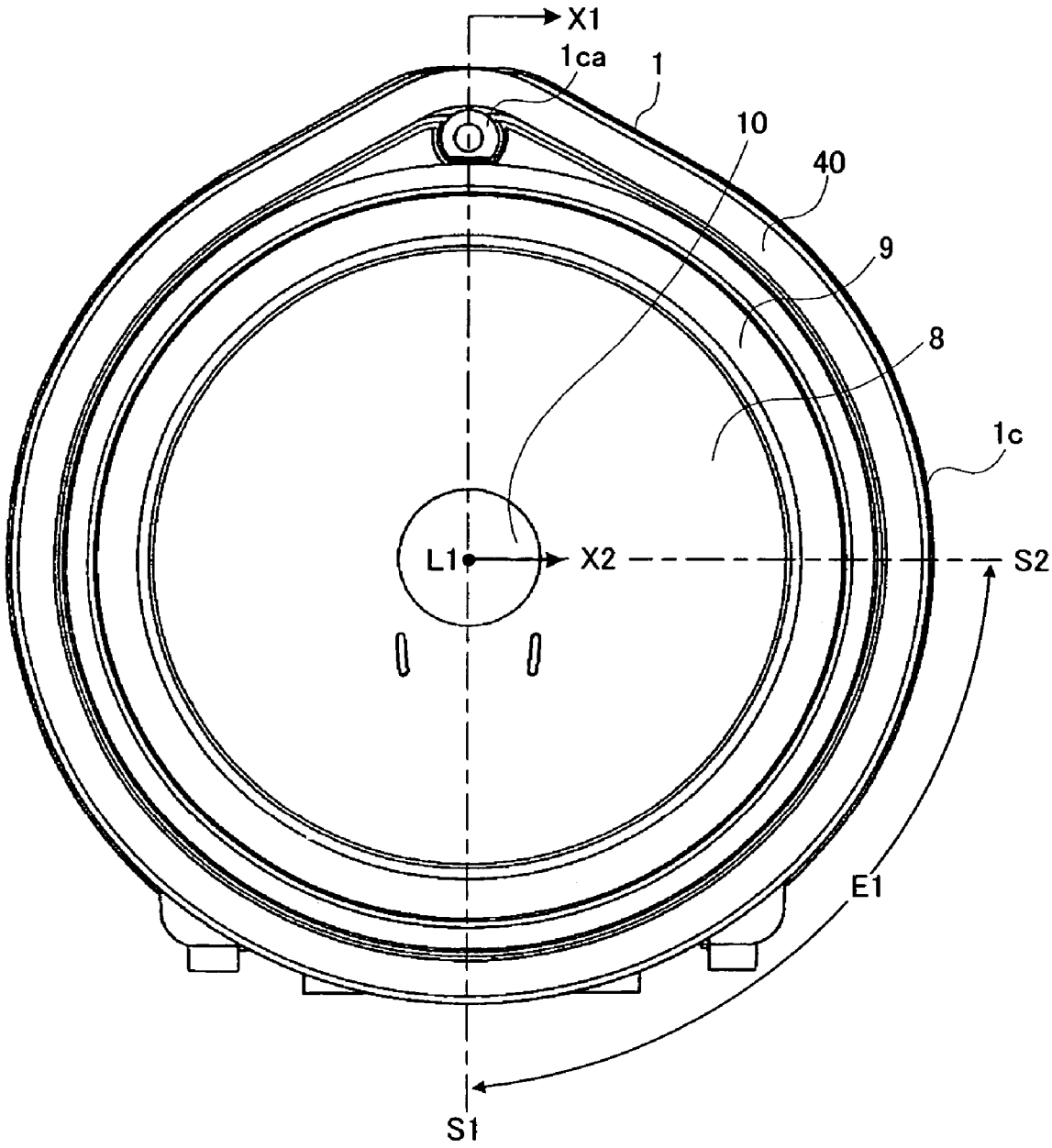
FIG. 3 shows a front view of the speaker device according to this embodiment.
Figure 4:
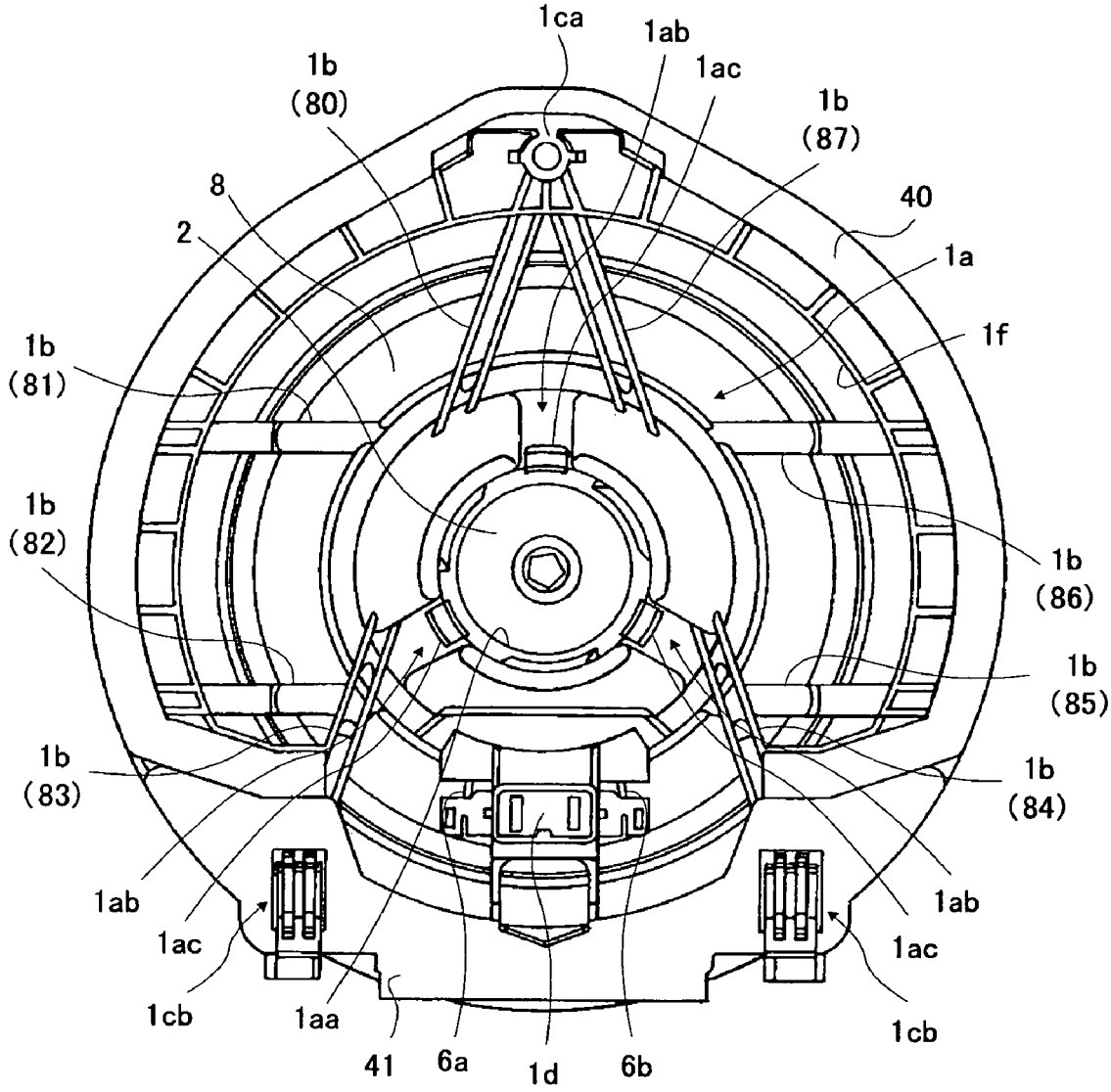
FIG. 4 is a rear view of the speaker device according to this embodiment.
Figure 5:
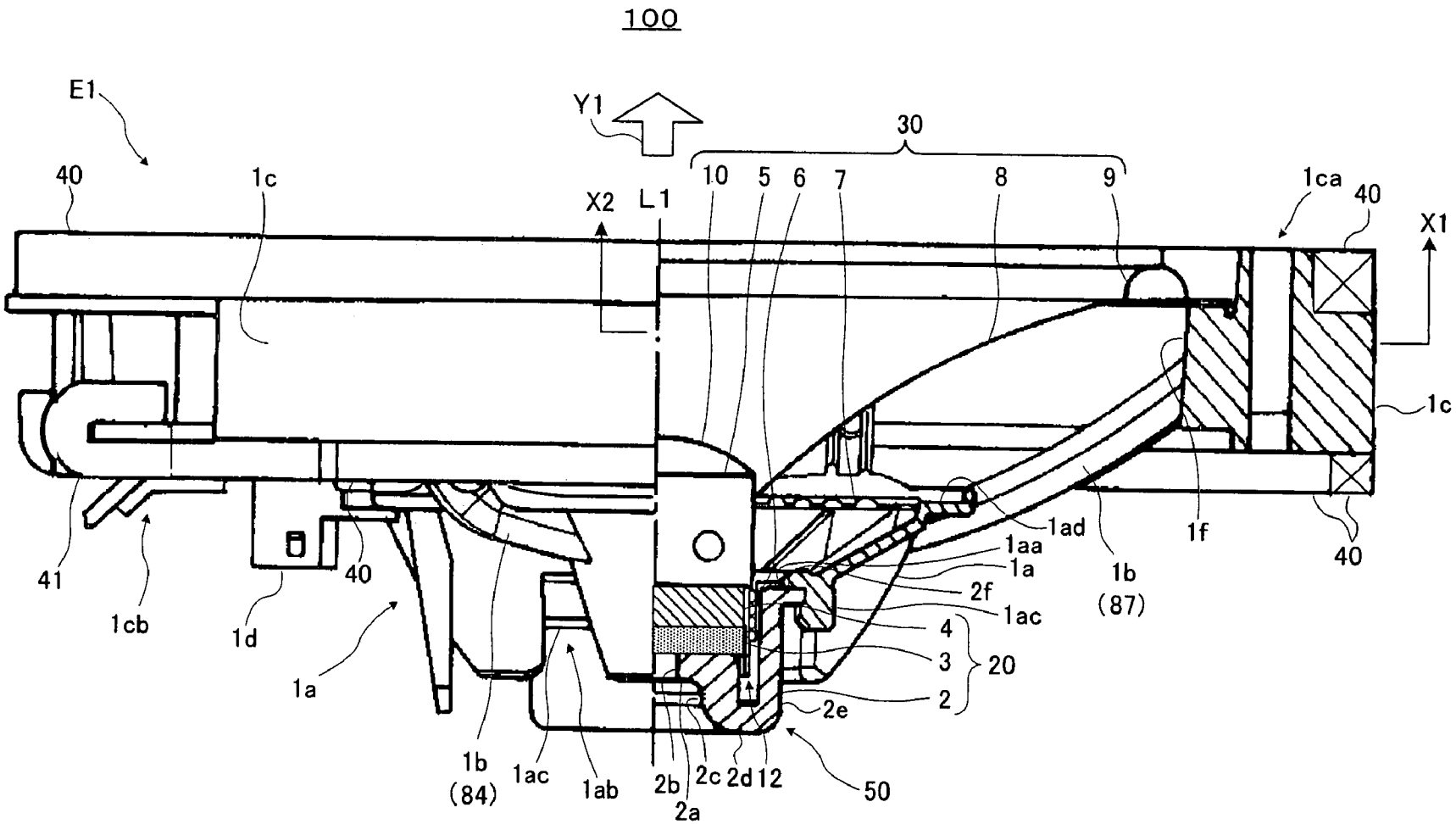
FIG. 5 shows a one-side sectional view and a one-side side view of the speaker device according to this embodiment.

FIG. 1 shows a perspective view of the speaker device 100 according to an embodiment of the present invention in a case that it is observed from its sound output side. FIG. 2 shows a perspective view of the speaker device 100 in a case that it is observed from a side opposite to the sound output side, i.e., from a rear side. FIG. 3 shows a front view of the speaker device 100 in the case that it is observed from the sound output side. FIG. 4 shows a rear view of the speaker device 100 in the case that it is observed from the side opposite to the sound output side, i.e., from the rear side. FIG. 5 shows a sectional view of the speaker device 100 on the right side of the drawing with respect to a central axis L1 of the speaker device 100 (or a frame 1) and a side view of the speaker device 100 on the left side of the drawing with respect to the central axis L1, respectively. In addition, the sectional view shown on the right side of FIG. 5 is a sectional view taken along the cutting-plane line X1-X2 of the speaker device 100 shown in FIG. 3. The side view shown on the left side of FIG. 5 corresponds to a side surface portion E1 of the speaker device 100 between a plane surface S1 passing through the central axis L1 of the speaker device 100 and a plane surface S2 passing through the central axis L1 and perpendicular to the plane surface S1 in FIG. 3.

The speaker device 100 according to this embodiment can be preferably used as an on-vehicle speaker device. The speaker device 100 is configured by mounting a speaker unit 50 onto the frame 1.

The speaker unit 50 includes a magnetic circuit system 20 having a yoke 2, a magnet 3 and a plate 4, and a vibrating system 30 having a voice coil bobbin 5, a voice coil 6, a damper 7, a diaphragm 8, an edge 9 and a cap 10.

First, each component of the magnetic circuit system 20 will be explained.

The magnetic circuit system 20 is configured as an internal magnet type magnetic circuit.

The yoke 2 is formed into a substantial pot shape. The yoke 2 has a first flat portion 2*a* for supporting a disc-shape magnet 3, an opening 2*b* formed at a substantial center of the first flat portion 2*a*, a first cylindrical portion 2*c* connected to an outer peripheral portion of the first flat portion 2*a*, a second flat portion 2*d* connected to a lower end portion of the first cylindrical portion 2*c*, a second cylindrical portion 2*e* connected to an outer peripheral portion of the second flat portion 2*d* and a flange portion 2*f* connected to an upper end portion of the second cylindrical portion 2*e* and outwardly extending from the upper end portion. Each of the components is integrally formed.

An upper surface of the first flat portion 2*a* has flatness. The opening 2*b* has a function of radiating a heat generated in the magnetic circuit system 20 to the outside. The first cylindrical portion 2*c* is formed into a cylindrical shape. In FIG. 5, by forming the first cylindrical portion 2*c* to have a predetermined length in the direction of an arrow Y1, a relative positional relation of components of the vibrating system 30 with respect to the magnet 3 and the plate 4 can be adjusted. A lower surface of the second flat portion 2*d* has flatness. The second flat portion 2*d* has a function of forming a constant gap between the first cylindrical portion 2*c* and the second cylindrical portion 2*e*. The second cylindrical portion 2*e* is formed into a cylindrical shape and is provided on the outer side of the first cylindrical portion 2*c*. The second cylindrical portion 2*e* has a function of forming a magnetic gap 12 between an inner peripheral wall of the second cylindrical portion 2*e* and each of the outer peripheral walls of the magnet 3 and the plate 4. The flange portion 2*f* is fixed to a magnetic circuit housing unit 1*a* being a component of the frame 1. By mounting the flange portion 2*f* onto the magnetic circuit housing unit 1*a*, the magnetic circuit system 20 can be housed in the magnetic circuit housing unit 1*a*.

The magnet 3 is formed into a disc shape and is mounted onto the first flat portion 2*a* of the yoke 2. On the magnet 3, the disc-shape plate 4 having the substantially same diameter as the magnet 3 is mounted.

In the magnetic circuit system 20 having such a configuration, the magnet 3 and the plate 4 configure the magnetic circuit, and magnetic flux of the magnet 3 is concentrated on the magnetic gap 12 formed between the outer peripheral wall of the plate 4 and the inner peripheral wall of the second cylindrical portion 2*e*.

Next, each component of the vibrating system 30 will be explained.

The voice coil bobbin 5 is formed into a substantially cylindrical shape. The voice coil 6 which will be explained later is wound around the vicinity of the lower end portion of the outer peripheral wall of the voice coil bobbin 5. The vicinity of the lower end portion of the inner peripheral wall of the voice coil bobbin 5 is opposite to each of the outer peripheral walls of the magnet 3 and the plate 4 with constant spaces therebetween. Meanwhile, the vicinity of the lower end portion of the outer peripheral wall of the voice coil bobbin 5 is opposite to the vicinity of the upper end portion of the inner peripheral wall of the second cylindrical portion 2*e* being the component of the yoke 2 with a constant space therebetween. A gap (magnetic gap 12) is formed between the inner peripheral wall of the second cylindrical portion 2*e* and the outer peripheral wall of the plate 4.

The voice coil 6 has one wiring, which includes a plus lead wire 6*a* and a minus lead wire 6*b* as shown in FIG. 4. The plus lead wire 6*a* is an input wiring for an L (or R)-channel signal, and the minus lead wire 6*b* is an input wiring for a ground (GND: ground) signal. The lead wires 6*a* and 6*b* are electrically connected to a terminal id provided on the frame 1. In addition, the terminal id is electrically connected to a wiring on an output side of an amplifier (not shown). Thereby, the signal and the power of one channel are inputted to the voice coil 6 from the amplifier side via the terminal id and the lead wires 6*a* and 6*b*.

The damper 7 is formed into an annular shape and has an elastic portion on which corrugations are concentrically formed. An inner peripheral edge portion of the damper 7 is mounted onto the vicinity of the upper end portion of the outer peripheral wall of the voice coil bobbin 5. Meanwhile, an outer peripheral edge portion of the damper 7 is mounted onto the outer peripheral portion of the magnetic circuit housing unit 1*a*.

Various kinds of materials such as paper, high polymer and metal can be applied to the diaphragm 8 in accordance with the various use purposes. The diaphragm 8 is formed into a cone shape. An inner peripheral edge portion of the diaphragm 8 is mounted onto the vicinity of the upper end portion of the outer peripheral wall of the voice coil bobbin 5 and onto the upper side of the damper 7. Meanwhile, the outer peripheral edge portion of the diaphragm 8 is mounted onto the inner peripheral edge portion of the annular edge 9. The outer peripheral edge portion of the edge 9 is mounted onto an outer peripheral portion 1*c* of the frame 1. In this example, the diaphragm 8 and the edge 9 are independently formed. However, this invention is not limited to this. Namely, the diaphragm 8 and the edge 9 may be integrally formed.

The cap 10 is formed into a substantial dome shape and is mounted onto the outer peripheral wall of the voice coil bobbin 5 in a manner to cover the upper surface of the voice coil bobbin 5. Thereby, it can be prevented that dust and foreign matter enter the inner side of the speaker unit 50.

The frame 1 is formed with various kinds of materials such as a metal and a resin. For the purpose of lightening the speaker device 100, the frame 1 is preferably formed with a resin material. The frame 1 mainly includes the magnetic circuit housing unit 1*a*, the outer peripheral portion 1*c* arranged on the outer side and the upper side of the magnetic circuit housing unit 1*a*, plural arm portions 1*b* connecting the magnetic circuit housing unit 1*a* and the outer peripheral portion 1*c*, and the terminal id provided in the vicinity of the outer peripheral portion of the magnetic circuit housing unit 1*a*. Each of the components is integrally formed. In addition, on the frame 1, an opening 1*f* is formed between the magnetic circuit housing unit 1*a* and the outer peripheral portion 1*c*.

The magnetic circuit housing unit 1*a* is formed into a substantial bowl shape and has an opening 1*aa*, cut-out portions 1*ab* and plural fixing portions 1*ac*. The diameter of the opening 1*aa* is substantially same as an outside diameter of the second cylindrical portion 2*e* of the yoke 2. When the direction of the central axis L1 of the speaker device 100 is prescribed as the vertical direction in FIG. 5, the opening 1*aa* is formed at a position corresponding to the substantial center of the vertical direction of the magnetic circuit housing unit 1*a*. Each of the cut-out portions 1*ab* is formed by removing a part of the outer peripheral wall of the magnetic circuit housing unit 1*a*, and it is formed in the vicinity of the outer peripheral wall thereof with proper spaces therebetween. Each of the fixing portions 1*ac* is formed in the vicinity of the opening 1*aa* and at a position corresponding to the cut-out portion 1*ab*. In addition, each of the fixing portions 1*ac* is formed along the circumferential direction of the opening 1*aa* with proper spaces therebetween.

One end of each arm portion 1*b* is mounted onto the outer peripheral wall of the magnetic circuit housing unit 1*a*, and the other end thereof is attached to the inner peripheral wall of the outer peripheral portion 1*c*.

The outer peripheral portion 1*c* is formed into a substantially annular shape, and is provided on the outer side of the magnetic circuit housing unit 1*a* and the plural arm portions 1*b*. The outer peripheral portion of the edge 9 and cushion members 40 and 41 are mounted onto the outer peripheral portion 1*c*. The outer peripheral portion 1*c* has mounting portions 1*ca* and 1*cb* for mounting the speaker device 100 onto the mounting base such as an inner panel of the vehicle door, for example.

The mounting portion 1*ca* is an inserting hole into which a bolt is inserted, and is provided at the position opposite to the terminal id at the outer peripheral portion 1*c*. The mounting portions 1*cb* are formed into a claw shape, and they are provided at the position opposite to the mounting portion 1*ca* on the lower surface side of the outer peripheral portion 1*c* and in the vicinity of the terminal 1*d*. In addition, the one mounting portion 1*cb* and the other mounting portion 1*cb* are provided on the lower surface side of the outer peripheral portion 1*c* with a constant space therebetween.

To the upper surface of the outer peripheral portion 1*c* and a part of the lower surface of the outer peripheral portion 1*c*, a cushion member 40 having a cushion property and formed into a stick shape are attached in a state deformed into a substantial circle shape. As the cushion member 40, a member having an elastic property such as sponge and urethane is preferable, for example. In addition, to the other part of the lower surface of the outer peripheral portion 1*c* on the side of the plural mounting portions 1*cb*, a cushion member 41 formed with the same member as the cushion member 40 and formed into a shape shown in FIG. 5 is attached. Onto one surface of each of the cushion members 40 and 41, a seal having an adhesive property is printed or an adhesive is applied.

The above-mentioned speaker unit 50 is mounted onto the frame 1 in a manner which will be explained below. In FIG. 5, the voice coil bobbin 5 and the cap 10 being the components of the vibrating system 30 are inserted into the opening 1*aa* of the magnetic circuit housing unit 1*a* from the direction of the arrow Y1, and the upper end portion of the voice coil bobbin 5 and the cap 10 are disposed at the upper portion of the surface on the sound output side of the diaphragm 8. In this state, the flange portion 2*f* being the component of the yoke 2 is fixed to the plural fixing portions 1*ac* provided in the magnetic circuit housing unit 1*a*. In this manner, the speaker unit 50 is mounted onto an appropriate position of the frame 1, and the speaker device 100 is configured.

In the speaker device 100 having the above-mentioned configuration, the signal and power outputted from the amplifier are inputted to the voice coil 6 via the terminal 1*d*, and the lead wires 6*a* and 6*b* of the voice coil 6. Thereby, a driving force occurs to the voice coil 6 in the magnetic gap 12, which vibrates the diaphragm 8 in the direction of the central axis L1 of the speaker device 100 in FIG. 5. In this manner, the speaker device 100 emits an acoustic wave in the direction of the arrow Y1 shown in FIG. 5.

(Configuration of Frame)

Figure 6:
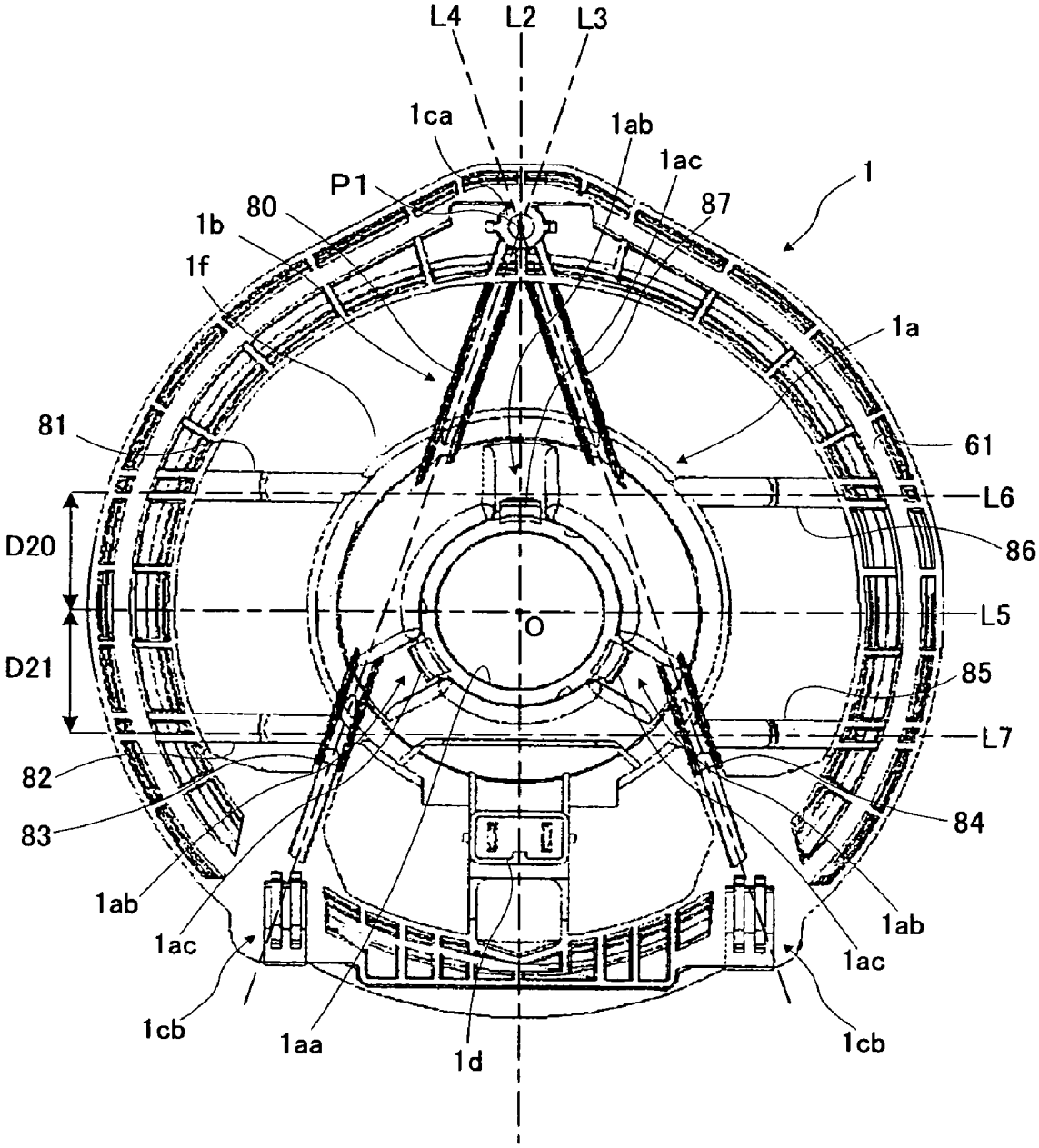
FIG. 6 shows a rear view of a frame according to an embodiment of the present invention.

Next, a description will be given of the configuration of the frame 1 characterizing the present invention, with reference to FIG. 6. FIG. 6 shows a rear view of the frame.

The basic configuration of the frame 1 is described above. Hereinafter, components of the frame 1 related to the characteristic part of the present invention will be mainly explained.

The frame 1 includes the one mounting portion 1*ca* and the mounting portions 1*cb* for mounting the speaker device onto the mounting base such as an inner panel of the vehicle door, and plural arm portions 1*b* connecting the magnetic circuit housing unit 1*a* and the outer peripheral portion 1*c*.

The one mounting portion 1*ca* is provided at the position opposite to the terminal 1*d* in the outer peripheral portion 1*c*. Concretely, the one mounting portion 1*ca* is provided at the position corresponding to 12 o'clock in the clockwise direction when the frame 1 is planarly observed. A center P1 of the one mounting portion 1*ca* is positioned on a central line L2 passing through a center O of the frame 1.

The one of the plural mounting portions 1*cb* is provided, on a side of a lower surface 61 of the outer peripheral portion 1*c*, at the position on the left side of the drawing with respect to the central line L2 and at the position on the lower side of the drawing with respect to a line L5 passing through the center O of the frame 1 and perpendicular to the central line L2. Concretely, the one mounting portion 1*cb* is provided at the position corresponding to 6 to 9 o'clock in the clockwise direction on the lower surface 61 of the outer peripheral portion 1*c* when the frame 1 is planarly observed from the rear side, as shown in FIG. 6. Meanwhile, the other mounting portion 1*cb* of the plural mounting portions 1*cb* is provided, on the side of the lower surface 61 of the outer peripheral portion 1*c*, at the position on the right side of the drawing with respect to the central line L2 and at the position on the lower side of the drawing with respect to the line L5 when the frame 1 is planarly observed from the rear side. Concretely, as shown in FIG. 6, the other mounting portion 1*cb* is provided at the position corresponding to 3 to 6 o'clock in the clockwise direction on the lower surface 61 of the outer peripheral portion 1*c* when the frame 1 is planarly observed from the rear side. According to the above-mentioned configuration, the one mounting portion 1*cb* and the other mounting portion 1*cb* are symmetrically positioned with respect to the central line L2.

The plural arm portions 1*b* include at least arm portions 80 to 87.

In FIG. 6, a line connecting the center P1 of the mounting portion 1*ca* and the one mounting portion 1*cb* positioned on the left side of the drawing with respect to the central line L2 is prescribed as a line L3. In addition, a line connecting the center P1 of the mounting portion 1*ca* and the other mounting portion 1*cb* positioned on the right side of the drawing with respect to the central line L2 is prescribed as a line L4. The line L3 and the line L4 are symmetrically positioned with respect to the central line L2.

The arm portion 80 is arranged at the position on the left side of the drawing with respect to the central line L2 and at the position on the upper side of the drawing with respect to the line L5. An outer peripheral end of the arm portion 80 is fixed to the inner peripheral wall of the outer peripheral portion 1*c* corresponding to the position in the vicinity of the mounting portion 1*ca* and the position on the left side of the drawing with respect to the central line L2. Namely, an intersection of the extension line of the outer peripheral end of the arm portion 80 and the outer peripheral portion 1*c* coincides with the mounting portion 1*ca*. Meanwhile, an inner peripheral end of the arm portion 80 is fixed to the outer peripheral wall of the magnetic circuit housing unit 1*a* corresponding to the position in the vicinity of the cut-out portion 1*ab* positioned on the upper side of the drawing and the position on the left side of the drawing with respect to the central line L2. In addition, the arm portion 80 is formed into a curved shape to project on the front side of the drawing sheet (i.e., rear side of the speaker device), as shown in FIG. 2 and FIG. 6.

The arm portion 83 is arranged at the position on the left side of the drawing with respect to the central line L2 and at the position on the lower side of the drawing with respect to the line L5. An outer peripheral end of the arm portion 83 is fixed to the inner peripheral wall of the outer peripheral portion 1*c* corresponding to the position in the vicinity of the mounting portion 1*cb* on the left side of the drawing. Namely, an intersection of the extension line of the outer peripheral end of the arm portion 83 and the outer peripheral portion 1*c* coincides with the mounting portion 1*cb* positioned on the left side of the drawing. Meanwhile, an inner peripheral end of the arm portion 83 is fixed to the outer peripheral wall of the magnetic circuit housing unit 1*a* corresponding to the cut-out portion 1*ab* positioned on the left side of the drawing. In addition, the arm portion 83 is formed into a curved shape to project on the front side of the drawing (i.e., rear side of the speaker device), as shown in FIG. 2 and FIG. 6.

The arm portion 80 and the arm portion 83 are linearly positioned. Concretely, when the frame 1 is planarly observed, the arm portion 80 and the arm portion 83 are positioned on the line L2. Therefore, when a pair of the arm portion 80 and the arm portion 83 are regarded as one linear bridge (hereinafter, referred to as "first bridge") sandwiching the magnetic circuit housing unit 1*a*, the first bridge linearly connects the mounting portion 1*ca* and the mounting portion 1*cb* positioned on the left side of the drawing. Namely, an intersection of an extension line of one end (corresponding to the outer peripheral end of the arm portion 80) of the first bridge and the outer peripheral portion 1*c* coincides with the position of the mounting portion 1*ca*. At the same time, an intersection of an extension line of the other end (corresponding to the outer peripheral end of the arm portion 83) of the first bridge and the outer peripheral portion 1*c* coincides with the position of the mounting portion 1*cb* positioned on the left side of the drawing. In addition, the first bridge is formed into a curved shape and an arch shape.

The arm portion 87 is disposed at the position on the right side of the drawing with respect to the central line L2 and at the position on the upper side of the drawing with respect to the line L5. An outer peripheral end of the arm portion 87 is fixed to the inner peripheral wall of the outer peripheral portion 1*c* corresponding to the position in the vicinity of the mounting portion 1*ca* and at the position on the right side of the drawing with respect to the central line L2. Namely, an intersection of an extension line of the outer peripheral end of the arm portion 87 and the outer peripheral portion 1*c* coincides with the mounting portion 1*ca*. Meanwhile, an inner peripheral end of the arm portion 87 is fixed to the outer peripheral wall of the magnetic circuit housing unit 1*a* corresponding to the position in the vicinity of the cut-out portion 1*ca* positioned on the upper side of the drawing and the position on the right side of the drawing with respect to the central line L2. In addition, the arm portion 87 is formed into the curved shape to project on the front side of the drawing (i.e., rear side of the speaker device), as shown in FIG. 2 and FIG. 6. The arm portion 87 is formed into the same shape as the arm portion 80.

The arm portion 84 is arranged at the position on the right side of the drawing with respect to the central line L2 and at the position on the lower side of the drawing with respect to the line L5. An outer peripheral end of the arm portion 84 is fixed to the inner peripheral wall of the outer peripheral portion 1*c* corresponding to the position in the vicinity of the mounting portion 1*cb* positioned on the right side of the drawing. Namely, an intersection of an extension line of the outer peripheral end of the arm portion 84 and the outer peripheral portion 1*c* coincides with the mounting portion 1*cb* positioned on the right side of the drawing. Meanwhile, the inner peripheral end of the arm portion 84 is fixed to the outer peripheral wall of the magnetic circuit housing unit 1*a* corresponding to the cut-out portion 1*ab* positioned on the right side of the drawing. In addition, the arm portion 83 is formed into the curved shape to project on the front side of the drawing (i.e., rear side of the speaker device), as shown in FIG. 2 and FIG. 6. The arm portion 84 is formed into the same shape as the arm portion 83.

The arm portion 87 and the arm portion 84 are linearly positioned. Concretely, when the frame 1 is planarly observed, the arm portion 87 and the arm portion 84 are positioned on the line L4. Therefore, when a pair of the arm portion 87 and the arm portion 84 are regarded as one linear bridge (hereinafter, referred to as "second bridge") sandwiching the magnetic circuit housing unit 1*a*, the second bridge linearly connects the mounting portion 1*ca* and the mounting portion 1*cb* positioned on the right side of the drawing. Namely, an intersection of an extension line of one end (corresponding to the outer peripheral end of the arm portion 87) of the second bridge and the outer peripheral portion 1*c* coincides with the position of the mounting portion 1*ca*. At the same time, an intersection of an extension line of the other end (corresponding to the outer peripheral end of the arm portion 84) of the second bridge and the outer peripheral portion 1*c* coincides with the position of the mounting portion 1*cb* positioned on the right side of the drawing. In addition, the second bridge is formed into the same shape as the first bridge. The second bridge and the first bridge are symmetrically positioned with respect to the central line L2.

In addition, an area formed by the first bridge, the second bridge, and the outer peripheral portion 1*c* between the mounting portion 1*cb* positioned on the left side of the drawing and the mounting portion 1*cb* positioned on the right side of the drawing is formed into a substantial triangle. That is, the substantial triangle is inscribed in the inner peripheral wall of the outer peripheral portion 1*c* formed into the circle shape when it is planarly observed.

The arm portion 81 is disposed at the position on the left side of the drawing with respect to the central line L2 and at the position on the upper side of the drawing with respect to the line L5. The outer peripheral end of the arm portion 81 is connected to the inner peripheral wall of the outer peripheral portion 1*c* positioned on a line L6. At the same time, the inner peripheral end of the arm portion 81 is fixed to the outer peripheral wall of the magnetic circuit housing unit 1*a* positioned on the line L6. The line L6 is parallel with the line L5 and is positioned at the position away from the line L5 to the upper side of the drawing by a distance D20. Additionally, the arm portion 81 is formed into a substantial linear shape, not into the curved shape.

The arm portion 86 is disposed at the position on the right side of the drawing with respect to the central line L2 and at the position on the upper side of the drawing with respect to the line L5. An outer peripheral end of the arm portion 86 is fixed to the inner peripheral wall of the outer peripheral portion 1*c* positioned on the line L6. At the same time, an inner peripheral end of the arm portion 86 is fixed to the outer peripheral wall of the magnetic circuit housing unit 1*a* positioned on the line L6. The arm portion 86 is formed into the same shape as the arm portion 81. Additionally, the arm portion 81 and the arm portion 86 are linearly positioned. Concretely, when a pair of the arm portion 81 and the arm portion 86 are regarded as one linear bridge (hereinafter, referred to as "third bridge") sandwiching the magnetic circuit housing unit 1*a*, the third bridge is positioned on the line L6 perpendicular to the central line L2.

The arm portion 82 is arranged at the position on the left side of the drawing with respect to the central line L2 and at the position on the lower side of the drawing with respect to the line L5. An outer peripheral end of the arm portion 82 is fixed to the inner peripheral wall of the outer peripheral portion 1*c* positioned on a line L7. At the same time, an inner peripheral end of the arm portion 82 is fixed to the outer peripheral wall of the magnetic circuit housing unit 1*a* positioned on the line L7. The line L7 is parallel to the line L5 and positioned at the position away from the line L5 to the lower side of the drawing by a distance D21. In a preferable example, the distance D21 and the distance D20 may be set to the same length. The arm portion 82 is formed into the same shape as the arm portion 81.

The arm portion 85 is arranged at the position on the right side of the drawing with respect to the central line L2 and at the position on the lower side of the drawing with respect to the line L5. The outer peripheral end of the arm portion 85 is fixed to the inner peripheral wall of the outer peripheral portion 1*c* positioned on the line L7. At the same time, an inner peripheral end of the arm portion 85 is fixed to the outer peripheral wall of the magnetic circuit housing unit 1*a* positioned on the line L7. The arm portion 85 is formed into the same shape as the arm portion 82. The arm portion 82 and the arm portion 85 are linearly positioned. Concretely, when a pair of the arm portion 82 and the arm portion 85 are regarded as a linear bridge (hereinafter, referred to as "fourth bridge")

sandwiching the magnetic circuit housing unit 1*a*, the fourth bridge is positioned on the line L7 perpendicular to the central line L2.

This embodiment of the present invention having such a configuration has advantageous operation and effect in comparison with a comparative example which will be assumed below.

First, a configuration of the comparative example will be briefly described. The frame according to the comparative example includes the magnetic circuit housing unit having the magnetic circuit, the outer peripheral portion disposed on the outer side and the upper side of the magnetic circuit housing unit and having the plural mounting portions for mounting the speaker device onto the mounting base and plural arm portions formed into the linear shape for connecting the magnetic circuit housing unit and the outer peripheral portion.

Particularly, in the comparative example, each of the arm portions is arranged between the magnetic circuit housing unit and the outer peripheral portion to radially extend from the center of the frame. In addition, though each of the mounting portions is formed on the outer peripheral portion, it is not formed on the extension line of each of the arm portions at the outer peripheral portion. Namely, the frame according to the comparative example is not designed in consideration of the organic association (regularity) of the plural arm portions and the plural mounting portions.

When the frame having such a configuration is applied to the speaker device, a problem which will be described below may occur. Namely, in such a speaker device, at the time of driving, in accordance with the vibration of the diaphragm, the magnetic circuit vibrates in the direction opposite to the diaphragm due to the reaction thereof. Then, the vibration occurring in the magnetic circuit is transmitted to the outer peripheral portion via each of the arm portions. Thereby, deformation problematically occurs to the whole frame, which easily deteriorates sound quality.

On the contrary, the frame 1 of the present invention is designed in consideration of the organic association (regularity) of the plural arm portions 1*b* and the plural mounting portions 1*ca* and 1*cb*.

Concretely, first, in the present invention, when the frame 1 is planarly observed, the arm portions 80, 83, 87 and 84 are positioned between the magnetic circuit housing unit 1*a* and the outer peripheral portion 1*c* so that the arm portions 80 and 83 are positioned on the same line and the arm portions 87 and 84 are positioned on the same line. Additionally, the intersection of the extension line of the outer peripheral end of the arm portion 80 and the outer peripheral portion 1*c* and the intersection of the extension line of the outer peripheral end of the arm portion 87 and the outer peripheral portion 1*c* are made to coincide with the mounting portion 1*ca*, respectively. Further, the intersection of the extension line on the outer peripheral end side of the arm portion 83 and the outer peripheral portion 1*c* is made to coincide with the position of the mounting portion 1*cb* disposed on the left side of the drawing with respect to the central line L2 passing through the center P1 of the mounting portion 1*ca* and the center O of the frame 1 in FIG. 6, respectively. In addition, the intersection of the extension line of the outer peripheral end of the arm portion 84 and the outer peripheral portion 1*c* is made to coincide with the position of the mounting portion 1*cb* disposed on the right side of the drawing with respect to the central line L2 in FIG. 6.

Therefore, when the pair of the arm portions 80 and 83 and the pair of the arm portions 87 and 84 are regarded as the liner arms (first bridge and second bridge) sandwiching the magnetic circuit housing unit 1*a* respectively, the first bridge and the second bridge are symmetrically positioned with respect to the central line L2. Thereby, an area of the substantial triangle (in this example, substantial isosceles triangle) inscribed in the inner peripheral wall of the outer peripheral portion 1*c* is formed by the first bridge, the second bridge and the outer peripheral portion 1*c* positioned between the mounting portion 1*cb* positioned on the left side of the drawing and the mounting portion 1*cb* positioned on the right side of the drawing in FIG. 6. That is, since the area of the substantial triangle inscribed in the outer peripheral portion 1*c* is formed by the outer peripheral portion 1*c* and the first and second bridges, the outer peripheral portion 1*c* is reinforced from the inner side by the first bridge and the second bridge of the inscribed triangle. By the configuration, it becomes possible to enhance strength to a force applied to the outer peripheral portion 1*c* of the frame 1 from the outer side, particularly, strength to a force applied in the direction of the central line L2.

In the present invention, when the frame 1 is planarly observed, the arm portions 81, 86, 82 and 85 are disposed between the magnetic circuit housing unit 1*a* and the outer peripheral portion 1*c* so that the arm portions 81 and 86 are positioned on the same line and the arm portions 82 and 85 are positioned on the same line. In addition, when the pair of the arm portions 81 and 86 and the pair of the arm portions 82 and 85 are regarded as the third and fourth linear bridges sandwiching the magnetic circuit housing unit 1*a*, the third and fourth bridges are positioned on the lines L6 and L7 perpendicular to the central line L2, respectively. Namely, the third and fourth bridges are disposed on the upper and lower sides of the line L5 passing through the center O of the frame 1 and crossing the central line L2, respectively, when the frame 1 is planarly observed. By the configuration, it becomes possible to enhance the strength to the force applied to the outer peripheral portion 1*c* of the frame 1 from the outer side, particularly the strength to the force applied in the direction (the line L5 direction) perpendicular to the central line L2.

In the present invention, by the configuration of the first to fourth bridges connecting the two parts of the outer peripheral portion 1*c* without passing through the center O of the outer peripheral portion 1*c* of the frame 1, it becomes possible to improve the strength of the whole outer peripheral portion 1*c* of the frame 1.

Additionally, in the present invention, as described above, the intersections of the extension lines of the one ends of the first and second bridges (outer peripheral ends of the arm portions 80 and 87) and the outer peripheral portion 1*c* is made to coincide with the mounting portion 1*ca*, respectively. At the same time, the intersection of the extension line of the other end (the outer peripheral end of the arm portion 83) of the first bridge and the outer peripheral portion 1*c* is made to coincide with the one mounting portion 1*cb*, and the intersection of the extension line of the other end (the outer peripheral end of the arm portion 84) of the second bridge and the outer peripheral portion 1*c* is made to coincide with the other mounting portion 1*cb*.

Parts (i.e., parts of the mounting portions 1*ca* and 1*cb*, and hereinafter the same) of the outer peripheral portion 1*c* corresponding to the intersections are fixed on the mounting base such as a mounting panel of the vehicle. Thus, the parts structurally hardly vibrate at the time of the driving of the speaker device 100.

Therefore, at the time of the driving of the speaker device 100, even if the vibration occurring to the magnetic circuit by the above-mentioned principle is transmitted to the parts of the outer peripheral portion 1*c* corresponding to the intersections via the first and second bridges, the vibration is attenuated or disappears at the parts of the outer peripheral portion 1*c*. Thereby, it can be suppressed that the vibration occurring to the magnetic circuit at the time of driving the speaker device 100 is transmitted to the whole outer peripheral portion 1*c* of the frame 1. As a result, if the frame 1 of the present invention is applied to the speaker device 100, the whole frame 1 is hardly deformed as compared with the comparative example, which can prevent the sound quality from being easily deteriorated.

Additionally, as described above, in the comparative example, since the plural arm portions are formed into the linear shape, at the time of the driving of the speaker device 100, the stress easily concentrates on the specific parts of each of the arm portions, and the strength of each of the arm portions may be deteriorated. Meanwhile, in the present invention, particularly, since the first bridge and the second bridge are formed into the curved and arch shape, at the time of the driving of the speaker device 100, the stress does not concentrate on the specific parts of the first and second bridges unlike the comparative example. Namely, since the first and second bridges are formed into the curved and arch shape respectively, the stress added to the first and second bridges disperses. Therefore, the strength of the first and second bridges can be enhanced in this embodiment, in comparison with the comparative example. Though the third and fourth bridges are linearly formed in this embodiment, the third and fourth bridges may be formed into the arch shape, too.

The invention may be embodied on other specific forms without departing from the spirit or essential characteristics thereof. The present embodiments therefore to be considered in all respects as illustrative and not restrictive, the scope of the invention being indicated by the appended claims rather than by the foregoing description and all changes which come within the meaning an range of equivalency of the claims are therefore intended to embraced therein.

The entire disclosure of Japanese Patent Application No. 2005-040047 filed on Feb. 17, 2005 including the specification, claims, drawings and summary is incorporated herein by reference in its entirety.

What is claimed is:

1. A frame for a speaker device comprising:

a magnetic circuit housing unit which houses a magnetic circuit;

an annular outer peripheral portion which is arranged on an outer side of the magnetic circuit housing unit; and plural arm portions which connect the magnetic circuit housing unit and the outer peripheral portion, wherein the plural arm portions form such plural bridges that a pair of the arm portions are linearly positioned to connect two parts of the outer peripheral portion, and wherein each of the bridges does not pass through a center of the outer peripheral portion.

2. The frame for the speaker device according to claim 1, wherein the plural bridges include at least first and second bridges, and wherein the first and second bridges are arranged at positions corresponding to sides of a triangle inscribed in the outer peripheral portion.

3. The frame for the speaker device according to claim 2, wherein the outer peripheral portion has plural mounting portions provided on a mounting base, and wherein both ends of the first and second bridges are arranged at positions corresponding to the plural mounting portions.

4. The frame for the speaker device according to claim 2, wherein the first and second bridges are arranged at positions symmetrical with respect to a central line passing through the center of the outer peripheral portion and corresponding to a diameter of the outer peripheral portion, and wherein the plural bridges include bridges arranged at positions substantially crossing the central line.

5. The frame for the speaker device according to claim 4, wherein the bridges arranged at the positions substantially crossing the central line include third and fourth bridges, and wherein the third and fourth bridges are provided on an upper side and a lower side of a perpendicular line passing through the center of the outer peripheral portion and perpendicular to the central line, respectively, when the outer peripheral portion is planarly observed.

6. The frame for the speaker device according to claim 3, wherein the plural mounting portions include first to third mounting portions, wherein the first mounting portion is arranged at a position corresponding to 12 o'clock in a clockwise direction, the second mounting portion is arranged at a position corresponding to 3 to 6 o'clock in the clockwise direction, and the third mounting portion is arranged at a position corresponding to 6 to 9 o'clock in the clockwise direction, respectively, when the outer peripheral portion is planarly observed, wherein one ends of the first and second bridges are arranged at a position corresponding to the first mounting portion, respectively, and wherein another end of the first bridge is arranged at a position corresponding to the third mounting portion, and another end of the second bridge is arranged at a position corresponding to the second mounting portion, respectively.

7. The frame for the speaker device according to claim 6, wherein the first bridge is positioned on a line connecting the first mounting portion and the third mounting portion, and the second bridge is positioned on a line connecting the first mounting portion and the second mounting portion.

8. The frame for the speaker device according to claim 2, wherein the first and second bridges are formed into a curved and arch shape, respectively.

9. A speaker device comprising a frame, the frame comprising:

a magnetic circuit housing unit which houses a magnetic circuit;

an annular outer peripheral portion which is arranged on an outer side of the magnetic circuit housing unit; and plural arm portions which connect the magnetic circuit housing unit and the outer peripheral portion, wherein the plural arm portions form such plural bridges that a pair of the arm portions are linearly positioned to connect two parts of the outer peripheral portion, and wherein each of the bridges does not pass through a center of the outer peripheral portion.

* * * * *